United States Patent [19]

Alheid

[11] 4,358,484

[45] Nov. 9, 1982

[54] METHOD FOR HIGH SPEED SIZE APPLICATION

[75] Inventor: Robert J. Alheid, Beloit, Wis.

[73] Assignee: Beloit Corporation, Beloit, Wis.

[21] Appl. No.: 228,262

[22] Filed: Jan. 26, 1981

[51] Int. Cl.[3] ..... B05D 3/00

[52] U.S. Cl. ..... 427/296; 427/300; 427/345; 427/434.5; 427/439; 118/405; 118/407; 118/602; 118/612

[58] Field of Search ..... 118/602, 603, 407, 405, 118/419, 612; 427/345, 296, 300, 434.5, 439

[56] References Cited

U.S. PATENT DOCUMENTS 3,051,125 8/1962 Ahara et al. ..... 118/603
3,647,526 3/1972 Barnes ..... 427/345

FOREIGN PATENT DOCUMENTS 2010028 9/1971 Fed. Rep. of Germany ..... 118/603

*Primary Examiner*—Sam Silverberg
*Attorney, Agent, or Firm*—Hill, Van Santen, Steadman, Chiara & Simpson

[57] ABSTRACT

A method for the application of a sizing composition or the like to a traveling web under high speed conditions which involves passing the web into the nip formed between two counter-rotating rolls and supplying a sizing composition to the nip to thereby form a pond of sizing material on both sides of the traveling web. Additional amounts of sizing material are constantly being supplied to the ponds by means of a suitable applicator and nozzle arrangement, while the depth of the ponds is controlled continuously by the application of a reduced pressure to the existing ponds resulting in some of the sizing composition being drawn up into the applicator from where it is delivered to a reservoir for further circulation through the applicator.

6 Claims, 4 Drawing Figures

METHOD FOR HIGH SPEED SIZE APPLICATION

BACKGROUND OF THE INVENTION

1. Field of the Invention

The present invention is in the field of a method for applying a sizing composition to at least one side of a traveling web. In the preferred form of the invention, a continuous system is provided whereby a sizing composition is constantly being delivered to liquid ponds formed at the nip, and a vacuum is used to control the depth of the ponds to a sufficiently small value to facilitate high speed operation. Sizing composition withdrawn by means of the vacuum is recirculated to a reservoir from which it is fed into the ponds as required.

2. Description of the Prior Art

Sizing operations of the past have usually made use of a pond of liquid material consisting of a sizing or coating solution of a wide range of viscosities at the nip of a pair of oppositely rotating rolls. The paper web was directed through the coating nip for simultaneous application of the sizing composition onto both surfaces of the web.

Experience has shown that controlling the depth of the pond of sizing material at the nip is important in high speed application to control splashing and pond turbulence. If the pond becomes too thick, the entire operation must be slowed down. Furthermore, the inability to control pond depth precisely tends to provide an uneven flow of sizing agent along the cross machine direction of the paper thereby leading to a non-uniform application of the sizing.

SUMMARY OF THE INVENTION

The present invention provides a method for applying sizing material or the like to at least one side of a traveling paper web by passing the web into the nip between a pair of counter-rotating rolls, supplying a liquid sizing composition from a reservoir to the web at the line of contact between the rolls and the opposite sides of the web to thereby form ponds of sizing composition preferably on both sides of the web. A reduced pressure is applied to both ponds to thereby remove the sizing compositions from the ponds, which sizing material is returned to the reservoir for further continuous circulation. The flow of solution in this method occurs essentially parallel to the direction of web movement but opposite in direction so that variations in temperature and concentration gradients across the web are minimized.

The preferred apparatus according to the present invention makes use of a pair of counter-rotating rolls with a nip therebetween, and means for directing a paper web through the nip. A pair of applicator means is positioned, one on each side of the web, to deliver sizing composition and withdraw it from the vicinity of the nip. Each applicator means includes a housing and a baffle within the housing dividing the interior of the housing into isolated, parallel fluid flow passages terminating near the nip. A distributor is arranged to deliver a sizing composition to one of the flow passages to thereby form a pond of sizing composition at the nip. A reservoir for the sizing composition supplies the composition to the first flow passage. A vacuum means is connected to the other flow passage for withdrawing sizing composition from the pond. The withdrawn material is first delivered to a sump located in the housing, and is then withdrawn back into the reservoir for further recirculation.

BRIEF DESCRIPTION OF THE DRAWINGS

A further description of the present invention will be made in conjunction with the attached sheet of drawings illustrating one form thereof.

DESCRIPTION OF THE PREFERRED EMBODIMENTS

Figure 1:
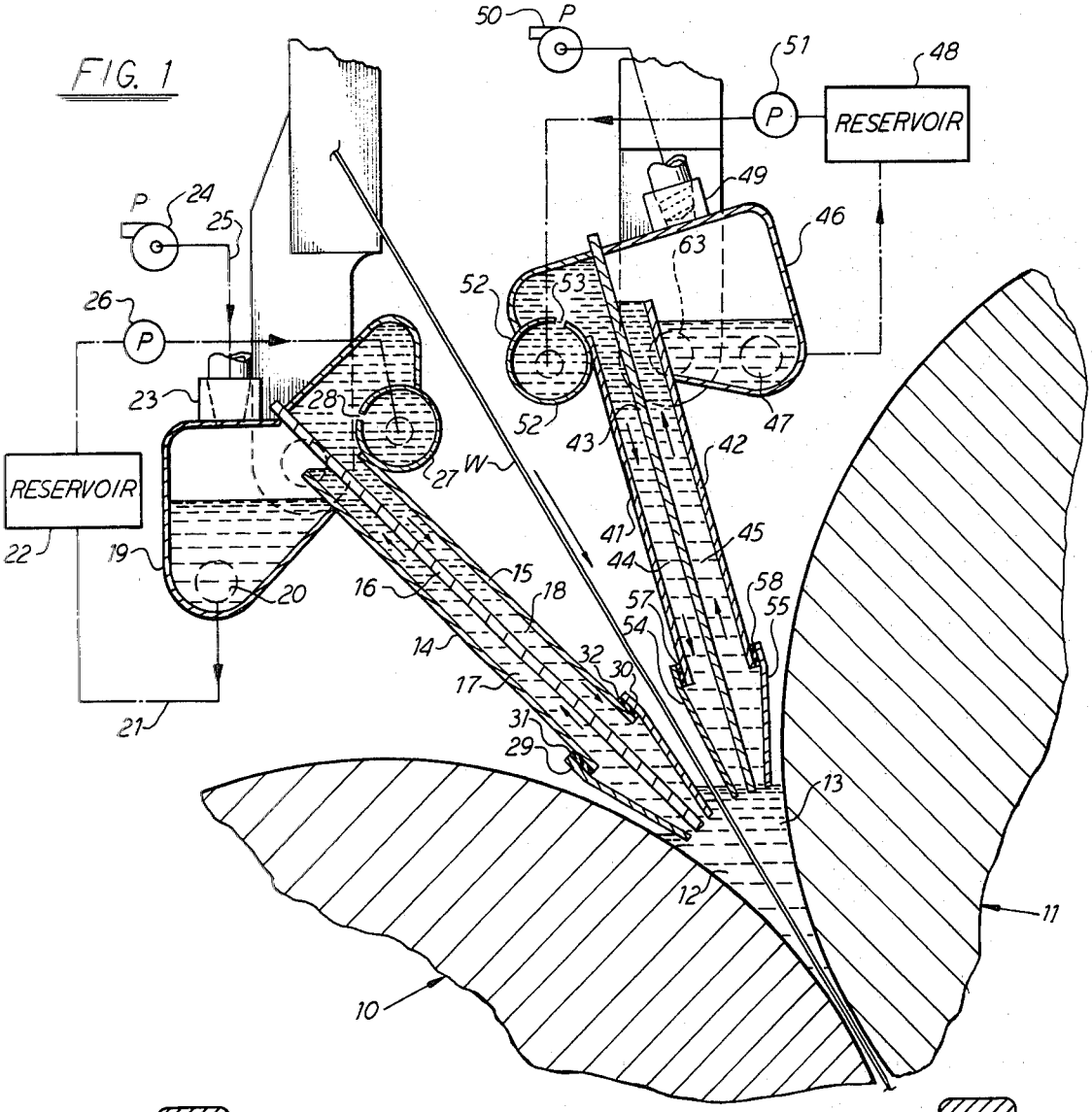
FIG. 1 is a fragmentary cross-sectional view, partly schematic, illustrating an apparatus which can be used for the purposes of the present invention.

In FIG. 1, reference numerals 10 and 11 refer to counter-rotating rolls defining a nip therebetween, the width of the nip being exaggerated in the drawings for purposes of clarity. A paper web W is delivered in the usual way into tangential contact with the peripheries of both rolls 10 and 11.

A liquid sizing composition is delivered to the vicinity of the nip between the rolls to form relatively shallow ponds 12 and 13 on opposite sides of the paper web W. It is necessary to control the depth of the ponds 12 and 13 carefully in order to prevent too small an amount of sizing being present in which case the coating would be uneven, or too great a depth in which case there would be splashing of the sizing material requiring a slowdown in operating speed.

The feed of the sizing material and the control of the depth of the ponds is accomplished by means of an applicator system of the type shown in FIG. 1. A housing is provided by means of two substantially parallel plates 14 and 15 which extend the full width of the roll 10 and are provided with end closures (not shown) to provide fluid-tight compartments therein. A central baffle 16 is provided between the plates 14 and 15 to divide the interior of the housing into isolated, parallel fluid flow passages 17 and 18, passage 17 being used for withdrawing sizing composition from the pond 12, and passage 18 being the fluid inlet for sizing composition into the pond.

A temporary storage means for sizing composition is provided by means of a sump 19 into which sizing composition withdrawn through the passage 17 is deposited. A discharge 20 and a conduit line schematically illustrated at 21 delivers the sizing composition from the sump 19 (by means of a pump, if necessary) into a reservoir 22. At the top of the sump 19 there is provided a fitting 23 which communicates with a source of vacuum such as a vacuum pump 24 through a vacuum line 25. In normal operation, the sizing composition is sufficiently viscous so that it deposits in the sump 19 after being withdrawn through the passage 17 by the operation of the vacuum pump 24. Sizing composition is continuously withdrawn from the sump 19 at a rate sufficient to prevent filling the sump.

A positive displacement pump 26 connected to the reservoir 22 delivers the sizing composition to a distributor 27. The distributor 27 has a plurality of spaced apertures 28 through which sizing composition can overflow and then find its way by gravity into the fluid inlet passage 18.

At the base of the applicator there is a nozzle type discharge provided by means of a pair of angular plates 29 and 30 which are secured to the plates 14 and 15 with the interposition of resilient sealing strips 31 and 32, as illustrated.

The arrangement on the other side of the web W is substantially the same as described. There is an applicator formed by a pair of parallel plates 41 and 42 separated by means of a centrally located baffle 43 which subdivides the interior of the applicator into isolated parallel flow passage 44 for delivering sizing composition to the pond 13, and passage 45 for withdrawing sizing composition from the pond. A sump 46 discharges sizing composition through a discharge 47 into a reservoir 48. A fitting 49 provides a means for applying a reduced pressure from a vacuum pump 50.

Figure 2:
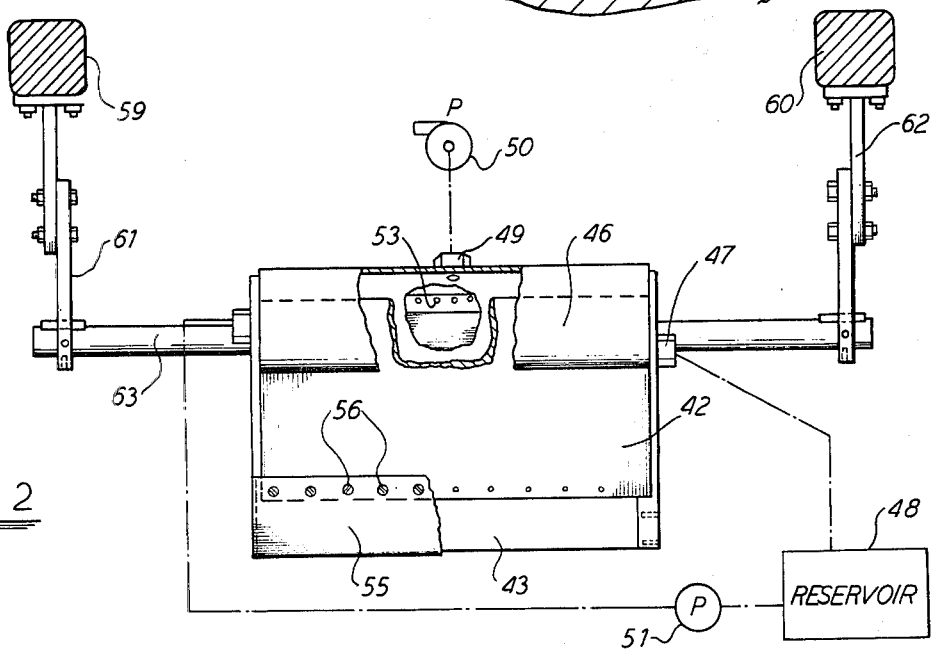
FIG. 2 is a side elevational view of the apparatus shown in FIG. 1.

A positive displacement pump 51 delivers the sizing composition from the reservoir 48 into a tubular distributor 52 having apertures 53 therein. Sizing composition flows through these apertures 53 into the inlet passage 44. At the discharge end, a pair of angular plates 54 and 55 are secured to the plates 44 and 45 as by means of screws 56 (FIG. 2). Flexible sealing elements 57 and 58 provide a liquid seal between the nozzle portion and the fluid flow passages in the applicator.

As illustrated in FIG. 2, the applicator assemblies can be rigidly fixed to a pair of cross members 59 and 60 by providing a pair of adjustable arms 61 and 62 secured thereto, and a shaft 63 on which the applicator is mounted.

It will be seen that the pressure of the rolls 10 and 11 forces the sizing agent in the ponds 12 and 13, respectively, into the web W as it passes through the nip. The depth of the ponds 12 and 13 is limited by the vacuum removal system which also provides for supply of sizing to the ponds. The rate of supply and removal is adjusted to maintain a uniformity of solution which is also aided by the constant circulation of the sizing composition. The method and apparatus of the present invention not only limits pond depth so that higher speeds can be obtained, but also eliminate cross-machine flow of the sizing agent so that there is greater cross-machine uniformity of (a) temperature, (b) viscosity, (c) percentage solids, and (d) size application.

Figure 3:
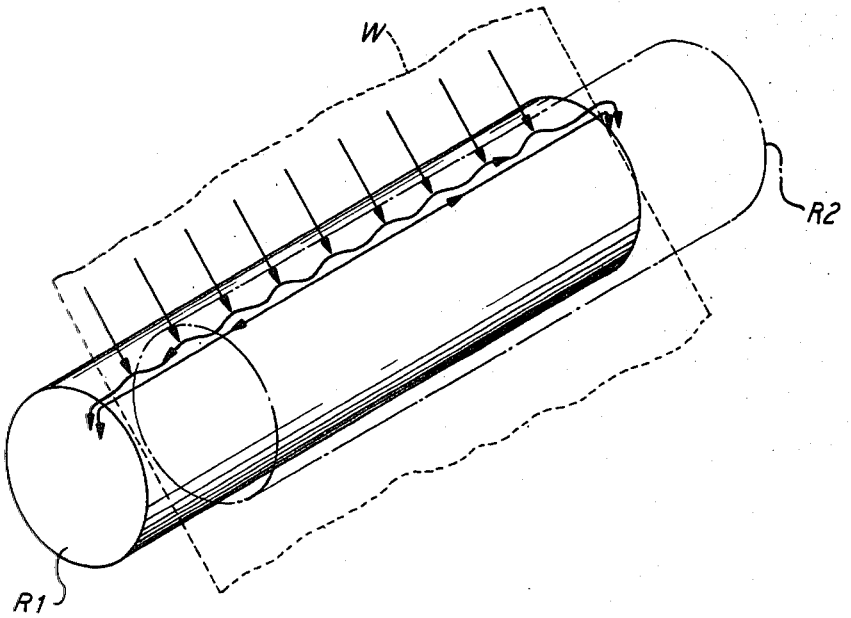
FIG. 3 (PRIOR ART)
FIG. 3 is a schematic illustration of how sizing material is applied using prior art techniques.
Figure 4:
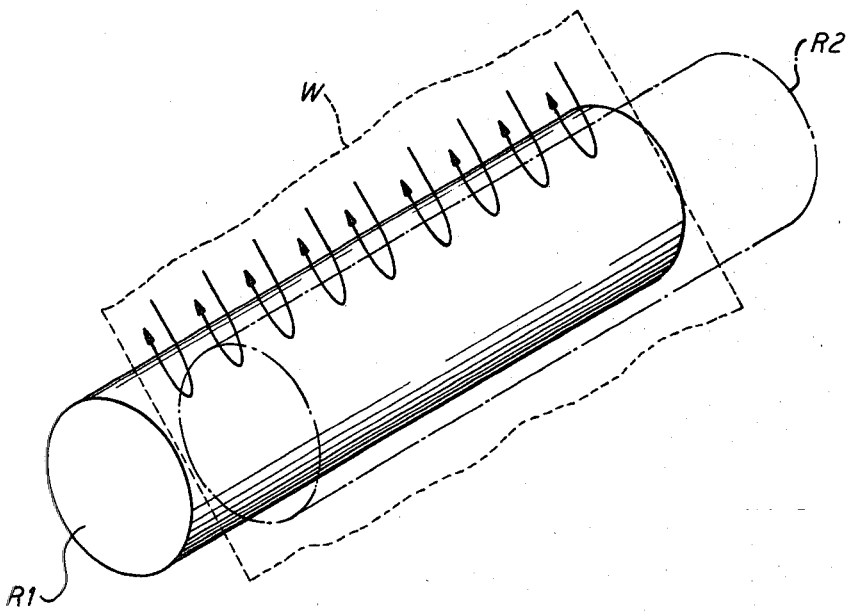
FIG. 4 is a schematic illustration of the counterflow of sizing composition which exists in the present invention.

The differences between the sizing application according to the prior art and the present invention are illustrated in FIGS. 3 and 4. In FIG. 3, there is illustrated a roll R1 and an oppositely rotating roll R2 cooperating therewith to define a nip through which a paper web W is arranged to pass. Sizing liquid is supplied at spaced points across the width of the rolls. Invariably, there is always a net outward flow of the sizing compound from the center to the outer edges of the rolls. This results in a non-uniformity of temperature between the center and the outer edges together with non-uniformity in viscosity and concentration of the sizing solution.

In contrast, the method of the present invention causes sizing solution flow of an entirely different nature, as shown in FIG. 4. The web W in passing through the nip defined by the rolls R1 and R2 is acted upon by a flowing sizing solution having velocity components (illustrated by the flow lines) which parallel the direction of web travel and during part of its travel runs counter to the direction of the traveling web. The precise control of sizing flow made possible by the described vacuum system substantially eliminates cross-machine gradients of temperature, viscosity and concentration, resulting in a more uniform distribution of sizing into the web.

It should be evident that various modifications can be made to the described embodiments without departing from the scope of the present invention.

I claim as my invention:

1. A method for the application of a sizing composition to a traveling web which comprises:

moving the web into tangential contact with a rotating roll, delivering a sizing composition from a reservoir to the line of contact between said roll and said web to thereby form a coating pond of sizing composition at said line of contact confined between one side of said web and the periphery of said roll to thereby impregnate said one side of said web, applying a reduced pressure to said pond to thereby remove some of the sizing composition from said pond during coating, and recirculating the sizing composition withdrawn from said pond to said reservoir.

2. A method according to claim 1 in which:

said reduced pressure is applied continuously to said pond.

3. A method according to claim 1 in which:

said reduced pressure is applied continuously to said pond, and said sizing composition is delivered continuously from said reservoir to said pond, thereby keeping said sizing composition in substantially constant circulation.

4. A method for the application of a sizing composition to both sides of a traveling paper web which comprises:

passing said paper web into the nip between a pair of counter-rotating rolls, supplying a sizing composition from a reservoir to said web at the line of contact between said rolls and the opposite sides of said web to thereby form ponds of sizing composition on both sides of said web, applying a reduced pressure to both said ponds to thereby remove some of said sizing composition from said ponds, and returning the material so removed into said reservoir.

5. A method according to claim 4 in which:

said reduced pressure is applied continuously and the sizing composition is supplied continuously from said reservoir thereby keeping said sizing composition agitated, said sizing composition flowing substantially parallel to the direction of web movement and counter thereto thereby providing substantially uniform temperature, viscosity and concentration across the width of the web.

6. A method for the application of a sizing composition to a traveling web which comprises:

moving the web into tangential contact with a rotating roll, continuously delivering a sizing composition under positive pressure from a reservoir to the line of contact between said web and said roll thereby forming a pond of sizing composition between said web and said roll, and continuously applying a reduced pressure to the sizing composition in said pond to withdraw sizing composition in a direction opposite to that along which it was introduced into said pond to thereby keep the sizing pond at a predetermined depth.

* * * * *